United States Patent [19]

Higgins

[11] Patent Number: 4,817,274

[45] Date of Patent: Apr. 4, 1989

[54] PULLER TOOL FOR MULTIPLE PIN CONNECTORS

[76] Inventor: Kent R. Higgins, 3104 Thrush La., Rolling Meadows, Ill. 60008

[21] Appl. No.: 154,285

[22] Filed: Feb. 10, 1988

[51] Int. Cl.[4] ..... H01R 43/00

[52] U.S. Cl. ..... 29/764; 29/267

[58] Field of Search ..... 29/764, 762, 741, 749, 29/758, 267

[56] References Cited

U.S. PATENT DOCUMENTS

| | | | |
|---|---|---|---|
| 3,117,370 | 1/1964 | Kauppi et al. | 29/762 X |
| 4,152,827 | 5/1979 | Walton, II | 29/764 |
| 4,468,858 | 9/1984 | Gulberg et al. | 29/764 |
| 4,615,110 | 10/1986 | Crone | 29/741 |

*Primary Examiner*—Carl E. Hall

[57] ABSTRACT

A multiple pin electrical connector decoupler or puller that separates the connector frames with a hand grip operated elongated rectilinear slide inserted between the frames.

15 Claims, 3 Drawing Sheets

PULLER TOOL FOR MULTIPLE PIN CONNECTORS

BACKGROUND OF THE INVENTION

Multiple pin connectors have become increasingly popular as releasable electrical conductor connectors over the past decade because of their capability of accommodating a large number of conductors in a single frame so that all conductors are connected and disconnected simultaneously with a single movement. These multiple pin connectors are manufactured by many connector manufacturers including TRW Corporation.

This type of multiple pin connector is manufactured in a wide variety of pin numbers including 9, 15, 31 and 37 pins, as well as others. They all include male and female connector members, each with an elongated rectangular plate frame. The male connector includes an elongated rectangular pin housing attached to the rectangular frame with rows, usually two or three, of aligned equally spaced pins that extend through apertures in a one-piece guide mounted in that housing. The female connector has a similar elongated housing that is sized to snugly internally receive the elongated male housing. Mounted in the female connector housing is a similar number of rows of tubes that are spaced and sized to snugly receive the pins in the male connector with outer diameters sized to be snugly received in the guide apertures in the male connector.

Because of the narrow, elongated shape of these connectors, disconnection is somewhat difficult because when the technician manually grasps the ends of one connector in attempting to disconnect, the frame usually tilts somewhat making disconnection difficult, but even more importantly, this tilting motion frequently causes bending of the female tubes. If any of the female tubes become bent, it is usually necessary to replace the female connector, and this obviously requires resoldering each of the connectors to the replaced connector.

In some cases, this tilting action causes a sufficient misalignment of one or more of the pins in the male connector to such an extent that they engage and bind on the distal ends of the female tubes in the female connector and such a condition necessitates replacement of the male connector and the time-consuming task of resoldering each and every one of the conductors to the replaced connector.

It is a primary object of the present invention to facilitate disconnection of multiple pin electrical connectors while minimizing the possibility of damage to the female connector tubes and the male connector pins.

SUMMARY OF THE PRESENT INVENTION

In accordance with the present invention, a hand-grip operated multiple pine connector decoupler or puller is provided that separates the male and female connectors by maintaining near-perfect parallel relation between the two connector frames as they are separated without disturbing the pins and tubes in any way.

Toward this end, the present connector decoupler or puller includes a generally "L" shaped frame consisting of a bifurcated base portion with two arms adapted to engage one of the connector frames and a transverse handle portion extending outwardly from the base portion that has a pivotally mounted finger grip actuator therein connected to reciprocate a slide in pure rectilinear motion.

The slide is "U" shaped in configuration and mounted within the base portion for rectilinear movement by tongue and groove connections. The slide has opposed shoulders that are spaced with respect to the frame engaging base portion to fit under and engage the other connector frame.

The pivotally mounted hand grip actuator is connected to reciprocate the slide by a pair of floating links pivotally connected at one end to the actuator member and at the other end to the top portion of the slide.

The bifurcated configuration of the base portion of the body and the slide itself permits the connector conductors to pass freely through the decoupler without interfering with the decoupling operation and without significant bending of the conductor bundle.

The present decoupler or puller also accommodates connectors with transverse conductors through the provision of a slot extending through one of the base portion arms and one side of the internally mounted slide.

Other objects and advantages of the present invention will appear from the following detailed description.

DETAILED DESCRIPTION OF THE PREFERRED EMBODIMENTS

Figure 1:
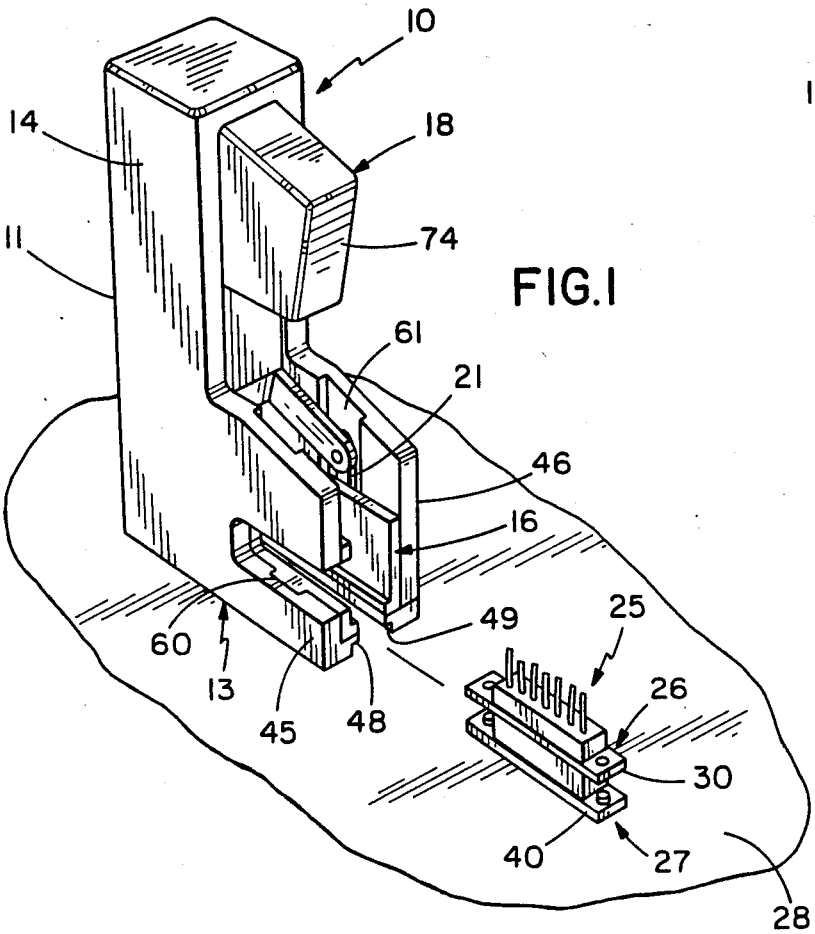
FIG. 1 is a perspective view of the present decoupler or puller shown exploded from an exemplary multiple pin connector prior to insertion of the puller around the connector.
Figure 2:
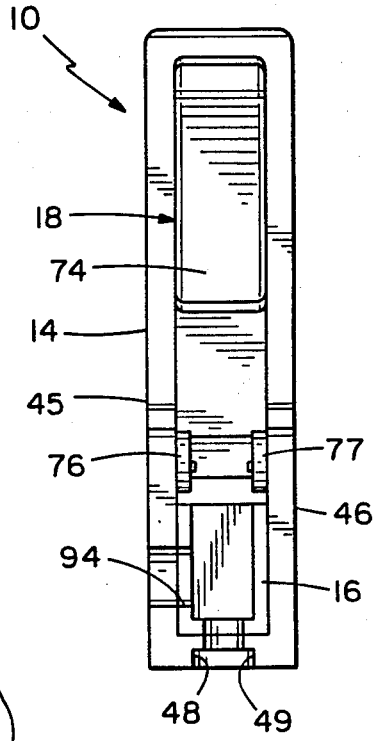
FIG. 2 is a front view of the decoupler-puller illustrated in FIG. 1.

Referring to the drawings, and particularly FIGS. 1 to 7, the present multiple pin connector decoupler or puller is generally designated by the reference number 10 and is seen to include an "L" shaped body 11 having a base portion 13 and an upstanding handle portion 14, a generally "U" shaped slide member 16 mounted for reciprocation in body base portion 13, and a pivotally mounted hand grip actuator 18 mounted in the handle portion 14 of the body and connected to operate slide 16 through parallel spaced short links 20 and 21.

An exemplary multiple pin connector 25 is illustrated in FIGS. 1 and 9 to 12, and while this is a 7 pin connector it should be understood there are usually a higher number of pins, and at least two rows of pins rather than the single row which has been shown in that form simply for clarity. It should also be understood that the problem noted above with respect to damaging pins and female connector tubes is exascerbated as the number of pins increases because not only does the higher number of pins increase the possibility of pin or tube damage, it also compounds the problem because connector replacement requires reattaching a higher number of conductors to the replacement connector.

Connector 25 is seen to include a male connector 26 and a female connector 27 attached to a board or frame 28. The male connector includes an elongated rectangular frame 30 that receives multiple conductors 31 and has an elongated generally rectangular housing 33 (FIG. 11) projecting from one side of the frame 30 that has an apertured guide 35 closely fitted therein having apertures 36 for each of its pins 38, with each pin being connected to one of the conductors 31.

Figure 11:
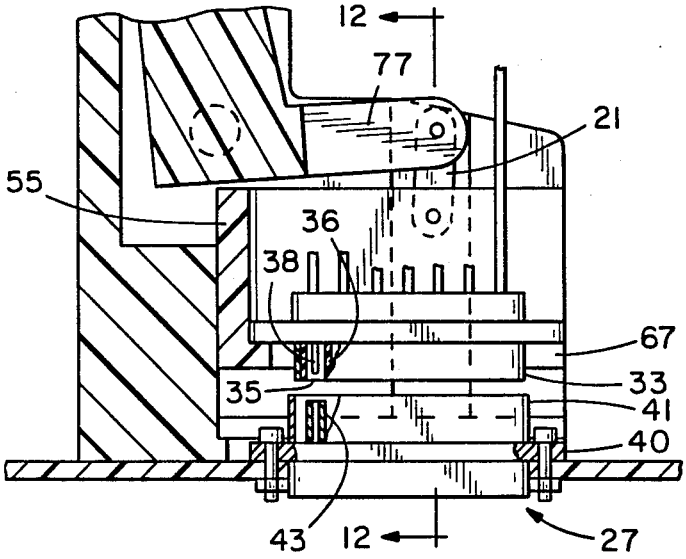
FIG. 11 is a longitudinal fragmentary section similar to FIG. 9 after actuation of the actuating member separating the male and female connectors.

The female connector 27, also viewed in FIG. 11, has a similar rectangular frame 40 with a rectangular housing 41 projecting from one side thereof that snugly receives male connector housing 33. A row of tubes 43 projects from frame 40 into housing 41, and they are positioned to snugly receive pins 38 and also are sized to have an outer diameter snugly received in guide apertures 38.

Turning to the detailed construction of the puller 10, the "L" shaped body is constructed of a one-piece plastic injection molding. The base portion 13 of the body includes spaced parallel arms 45 and 46, each with a groove 48, 49 in its lower surfaces spaced a distance just slightly larger than the width of female connector frame 40 with a height just slightly greater than the thickness of the frame 40 so that the grooves 48 and 49 slide over and engage the edges of the frame 40 as the puller is inserted over the connector in the position illustrated in FIGS. 9 to 12.

Figure 7:
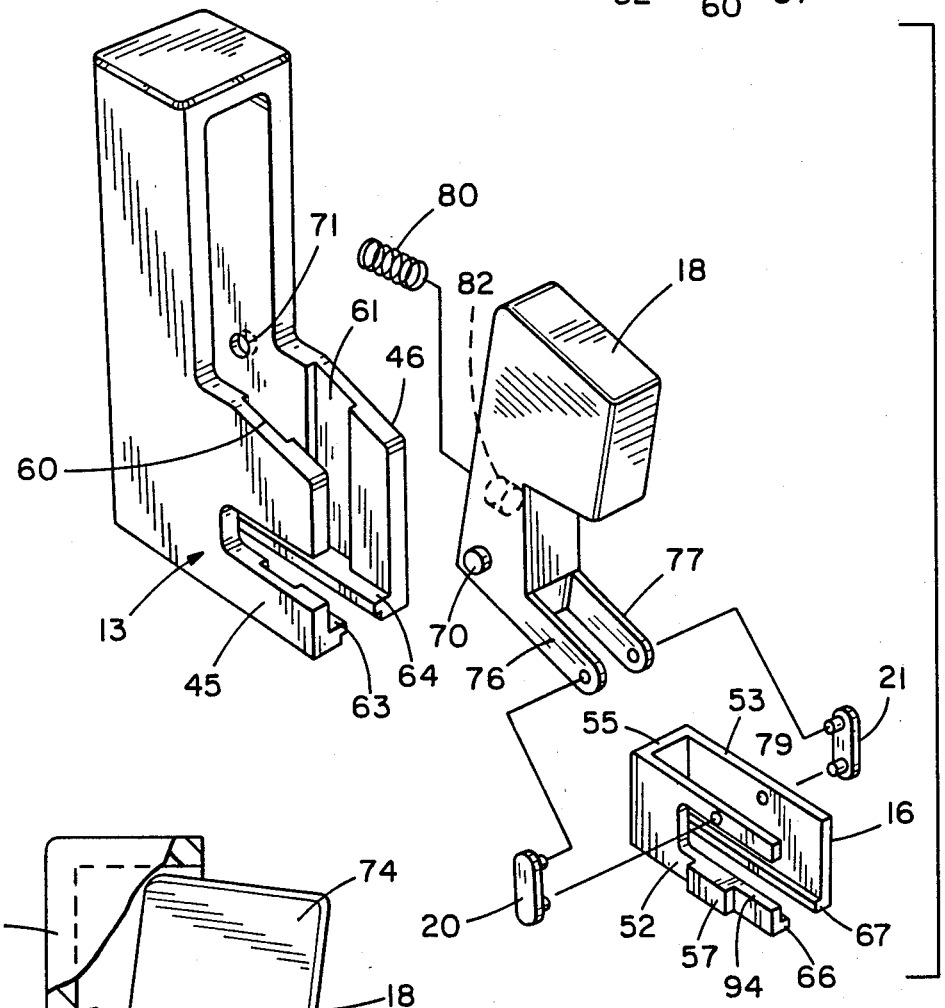
FIG. 7 is a perspective exploded view of all parts of the decoupler-puller according to the present invention.

The slide 16 illustrated clearly in FIG. 7, as well as most of the other FIGS., is a one-piece plastic injection molding and is seen to include spaced parallel arms 52 and 53 connected by a bight portion 55. The outer walls of the arms 52 and 53 have tongues 57 and 58 (See FIG. 12 also) that are slidably received in vertical slots 60 and 61 in the insdie of the body arms 45 and 46. Downward movement of the slide 16 in the base portion 13 of the body is limited by shoulders 63 and 64 on the lower portions of the arms 45 and 46. The linear engagement of the tongues 57 and 58 on the slide 16 with the grooves 60 and 61 in the body 11 assure that the slide 16 has pure linear reciprocating movement in the body without any tilting.

Figure 9:
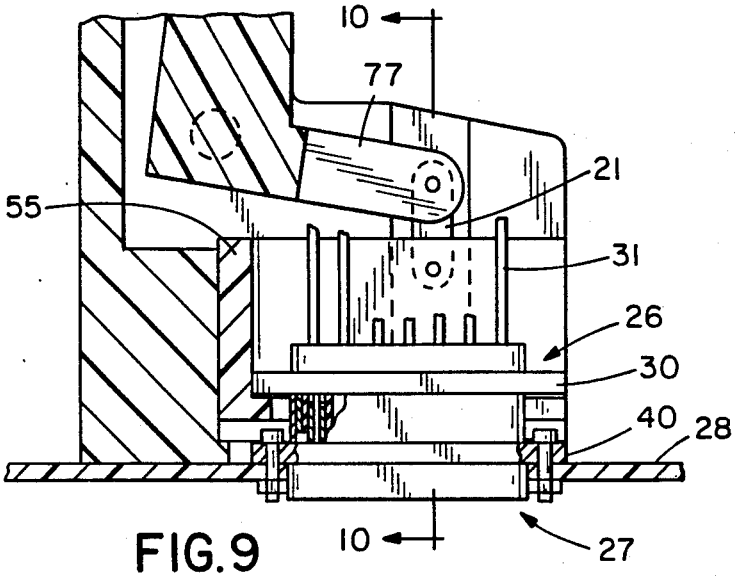
FIG. 9 is a fragmentary section of the present decoupler-puller similar to FIG. 8 around a connected connector.
Figure 10:
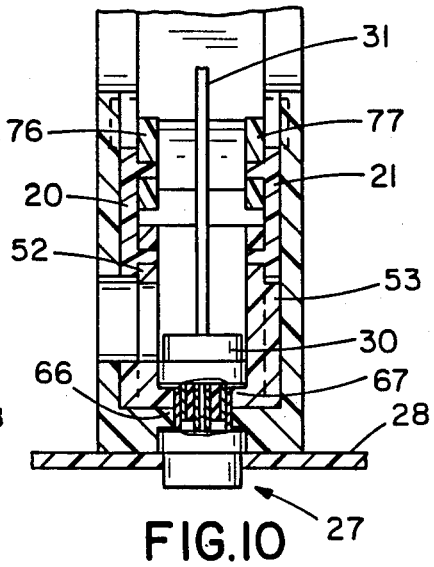
FIG. 10 is a transverse fragmentary section taken generally along line 10-10 of FIG. 9 prior to actuation.

The slide arms 52 and 53 have inwardly directed lower aligned flanges 66 and 67 that are spaced apart somewhat less than the width of the male connector frame 30 and parallel to and spaced from the base portion parallel grooves 48 and 49 such that they engage under the male frame 30 as the puller is placed over the connector as seen clearly in FIGS. 9 and 10.

The actuator member 18 is a one-piece plastic molding of generally "U" shaped configuration and is pivotally mounted within the lower part of the body handle portion 11 by a pin 70 that extends through aligned apertures 71 in the handle portion of the body 11. The actuator member 18 has a finger grip engageable portion 14 that projects from the handle portion in all positions thereof. The lower portion of the actuator 18 has integral spaced arms 76 and 77 extending generally parallel to slide 16 as seen in FIG. 4 that are pivotally connected to the short links 20 and 21 at the upper end of the links, which are, in turn, pivotally connected to the outside of the upper portion of the slide arms 52 and 53 through apertures 78 and 79 in the slide 16.

Figure 4:
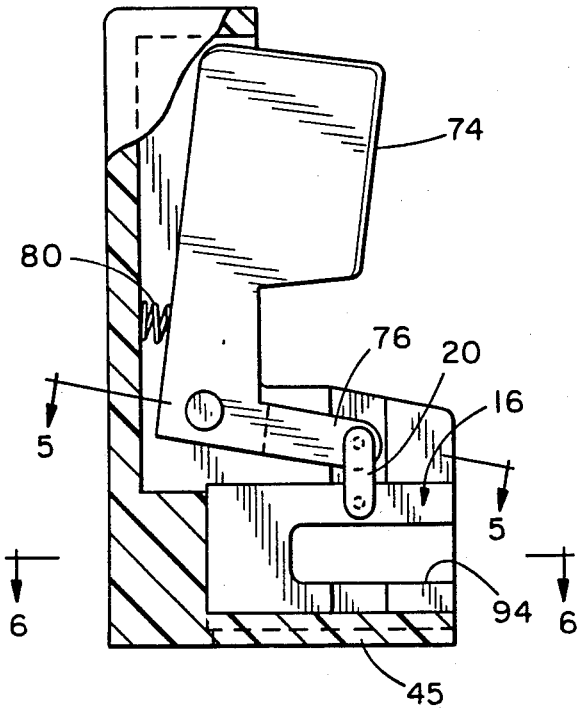
FIG. 4 is a fragmentary longitudinal section of the decoupler-puller illustrated in FIGS. 1 to 3 illustrating the interconnection between the actuator and the slide.
Figure 3:
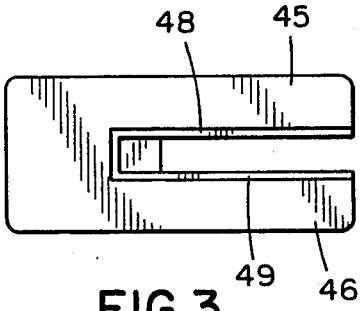
FIG. 3 is a bottom view of the decoupler-puller illustrated in FIG. 2.
Figure 5:
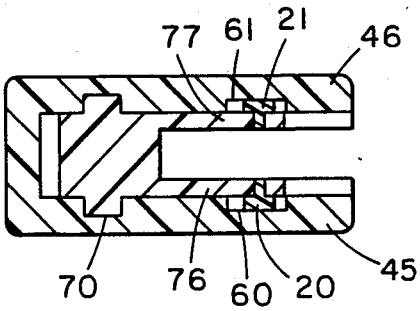
FIG. 5 is a cross-section taken generally along line 5—5 of FIG. 4.
Figure 6:
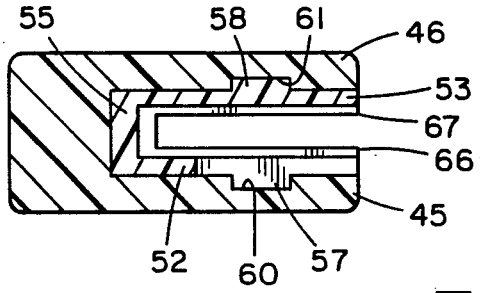
FIG. 6 is a cross-section taken generally along line 6—6 of FIG. 4 showing the tongue and groove connections between the slide and the body.

A coil compression spring 80 is seated in an aperture in the rear of the handle poriton 11 at one end and an aperture 82 in the rear of the actuator member 18 above pivot pin 77 so that the spring biases the actuator member in a clockwise direction as viewed in FIGS. 1, 4 and 7, which in turn, biases the slide 16 downwardly to its inactive position illustrated in FIGS. 1, 4, 8, 9 and 10. Links 20 and 21 translate the pivotal movement of arms 76 and 77 to the pure rectilinear movement of the slide 16.

Figure 8:
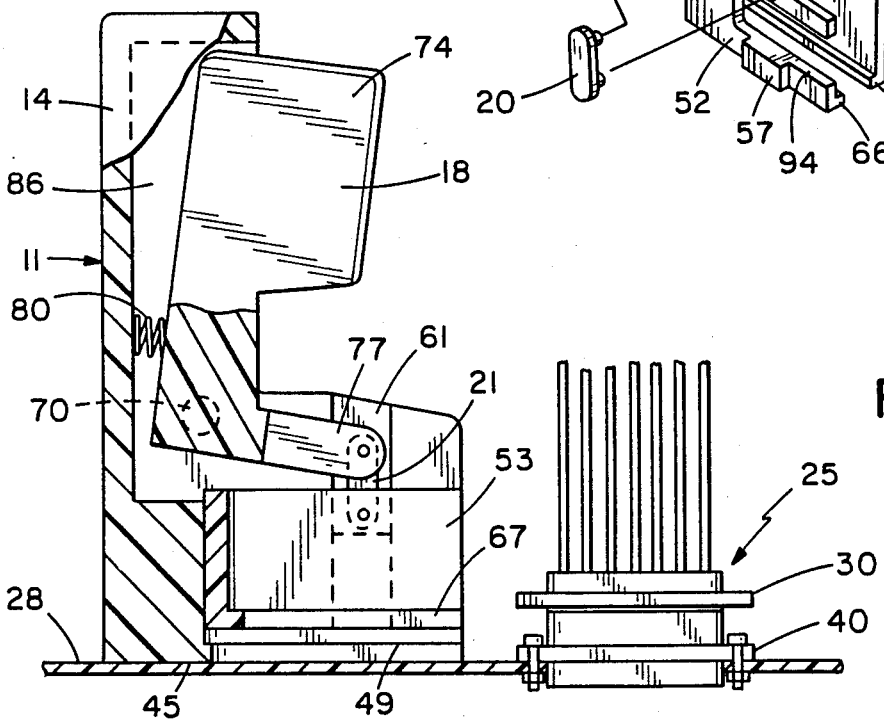
FIG. 8 is a fragmentary section of the present decoupler-puller in a position similar to FIG. 4, as it approaches an exemplary connector, particularly illustrating the spacing between the connector frames with respect to the spacing between the slide and the base portion of the puller.

The connector-puller 10 is slid around the connector 28 by engaging base portion lower surface 45 on the board or frame 28 and sliding it on the board around the connector 25 to the position illustrated in FIGS. 8 and 9. This movement engages grooves 48 and 49 on the top surface of the connector frame 40 and the slide flanges 66 and 67 on the underside of the connector frame 30. Note that the slide 16, as seen in FIG. 9, has a length substantially equal to the length of the connector frames 30 and 40 so that the grooves 48 and 49 and the flanges 66 and 67 engage the connector frames 4 and 30 throughout their length to assure the maintenance of a parallel relationship between the frames 30 and 40 as they separte from one another.

With one of the user's hands around the body handle portion 14 and with the fingers wrapped around the actuator projection 74, the actuator member is squeezed toward handle opening 86 causing the arms 76 and 77 and the links 20 and 21 to pull the slide 16 upwardly as viewed in the drawings, in turn causing the flanges 66 and 67 to pull the connector frame 30 away from the connector frame 40 against the biasing force of the base portion 13 engaging the board 28 and the upper surface of the connector frame 40.

Figure 12:
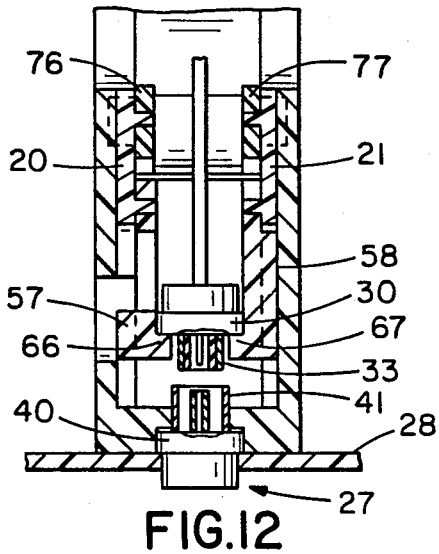
FIG. 12 is a transverse fragmentary section taken generally along line 12-12 of FIG. 11.

With the connector separated as seen in FIGS. 11 and 12, the entire puller can be immediately raised vertically upwardly without any reverse sliding movement and the male connector easily withdrawn from the slide 16 in a forward direction by grasping the associated conductor bundle.

Figure 13:
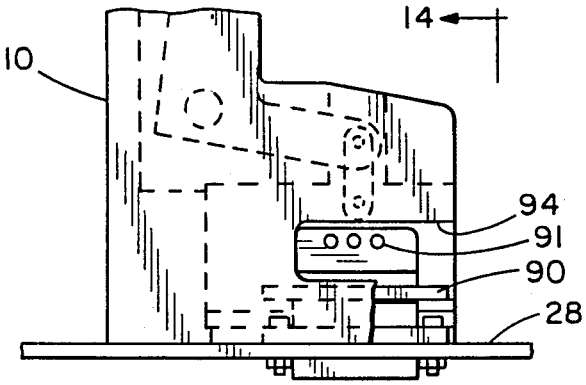
FIG. 13 is a fragmentary side view of the present decoupler-puller around a connector having transverse conductors on the male connector.
Figure 14:
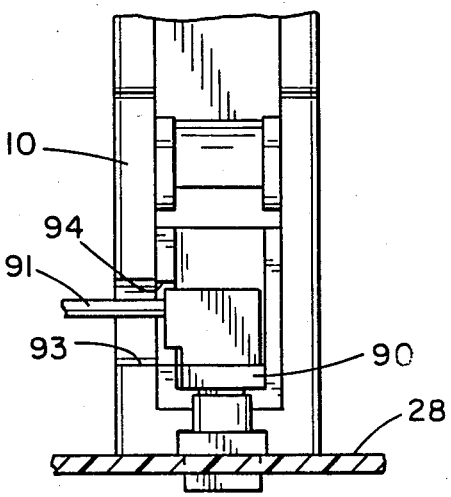
FIG. 14 is a front view taken generally along line 14-14 of FIG. 13.

As seen in FIGS. 13 and 14, the present puller 10 can also be used with a connector 90 having transverse conductors 91. This is accommodated with the provision of a slot 93 in the body arm 45 and a cooperating aligned congruent slot 94 in the slide arm 52. The connector 90 is separated in the same fashion as the connector 25 described in detail above.

I claim:

1. A puller for separating multiple pin electrical conductor connectors for the type having a male connector with a generally rectangular elongated frame and a female connector with a similar generally rectangular elongated frame parallel to and spaced from the male connector frame when the connectors are connected, each having an axis in the direction of elongation, comprising: a body having an elongated base portion for engaging the side of one of the connector frames facing the other frame, a puller slide mounted for pure linear reciprocating motion on the body and having an elongated portion for engaging the other frame on the side thereof facing the one frame so that when reciprocated will separate the frames while maintaining the parallel relation therebetween said elongated base portion and the sldie elongated portion being insertable between the male connector and the female connector in the direction of said axis of elongation without any transverse movement of the base portion or the slide elongated portion, and means on the body for actuating the puller slide.

2. A puller for separating multiple pin electrical conductor connectors of the type having a male connector with a generally rectangular elongated frame and a female connector with a similar generally rectangular elongated frame parallel to and spaced from the male connector frame when the connectors are connected, comprising: a body having an elongated base portion for engaging the side of one of the connector frames facing the other frame, a puller slide mounted for pure linear reciprocating motion on the body and having an elongated portion for engaging the other frame on the side thereof facing the one frame so that when reciprocated will separate the frames while maintaining the parallel relation therebetween, and means on the body for actuating the puller slide, the body having an integral handle portion extending transversely from the base portion and the slide elongated portion, said actuating means including an actuator member pivotally mounted in the body handle portion with a portion thereof projecting from the handle portion so the user actuates the slide by hand gripping the handle portion with the operator's fingers on the handle portion extending over and depressing the projecting portion of the actuator member toward the handle portion of the body.

3. A puller for separating multiple pin electrical conductor connectors as defined in claim 2, wherein the actuator member is pivotally and slidably connected to the puller side.

4. A puller for separating multiple pin electrical conductor connectors for the type having a male connector with a generally rectangular elongated frame and a female connector with a similar generally rectangular elongated frame parallel to and spaced from the male connector frame when the connectors are connected, comprising: a body having an elongated base portion for engaging the side of one of the connector frames facing the other frame, a puller slide mounted for pure linear reciprocating motion on the body and having an elongated portion for engaging the other frame on the side thereof facing the one frame so that when reciprocated will separate the frames while maintaining the parallel relation therebetween, and means on the body for actuating the puller slide, the body base portion including two parallel spaced arms each with grooves in the lower portions thereof adapted to receive and engage said one connector frame.

5. A puller for separating multiple pin electrical conductor connectors of the type having a male connector with a generally rectangular elongated frame and a female connector with a similar generally rectangular elongated frame parallel to and spaced from the male connector frame when the connectors are connected, comprising: a body having an elongated base portion for engaging the side of one of the connector frames facing the other frame, a puller slide mounted for pure linear reciprocating motion on the body and having an elongated portion for engaging the other frame on the side thereof facing the one frame so that when reciprocated will separate the frames while maintaining the parallel relation therebetween, and means on the body for actuating the puller slide, said puller slide including two parallel spaced arms each with a groove in the lower portion thereof adapted to receive and engage the other connector frame.

6. A puller for separating multiple pin electrical conductor connectors as defined in claim 3, including at least one link pivotally connected to the actuator member at one end and the puller slide at the other end to transmit pivotal motion of the actuator member to rectilinear motion of the puller slide.

7. A puller for separating multiple pin electrical conductor connectors of the type having a male connector with a generally rectangular elongated frame and a female connector with a similar generally rectangular elongated frame parallel to and spaced from the male connector frame when the connectors are connected, comprising: a body having an elongated base portion for engaging the side of one of the connector frames facing the other frame, a puller slide mounted for pure linear reciprocating motion on the body and having an elongated portion for engaging the outer frame on the side thereof facing the one frame so that when reciprocated will separate the frames while maintaining the parallel relation therebetween, and means on the body for actuating the puller slide, said slide and body having at least one cooperating tongue and groove interconnection to assure rectilinear movement between the slide and the body.

8. A puller for separating multiple pin electrical conductor connectors as defined in claim 1, wherein the slide and the body have openings therethrough to permit the conductors to freely pass through the body.

9. A puller for separating multiple pin electrical conductor connectors as defined in claim 1, wherein the slide and the body have openings therethrough transverse to the direction of the connector pins to permit the conductors to pass freely therethrough.

10. A puller for separating multiple pin electrical conductor connectors of the type having a male connector with a generally rectangular elongated frame and a female connector with a similar generally rectangular elongated frame parallel to and spaced from the male connector frame when the connectors are connected, comprising: a generally "L" shaped body consisting of an elongated base portion and a transverse handle portion, said base portion being bifurcated defining spaced base arms each having a groove in the lower portion thereof for receiving and engaging one of the connector frames, a puller slide having spaced parallel arms mounted within the base arms for rectilinear movement and each having a groove for receiving and engaging the side of the other connector frame facing the one connector frame, and actuator means for reciprocating the puller slide to separate the connectors.

11. A puller for separating multiple pin electrical conductor connectors as defined in claim 10, wherein said actuator means includes an actuator member pivotally mounted in the body handle portion with a portion thereof projecting from the handle portion so the user actuates the slide by hand gripping the handle portion with the operator's fingers on the gripping handle extending over and depressing the projecting portion of the actuator member toward the handle portion of the body.

12. A puller for separaating multiple pin electrical conductor connectors as defined in claim 11, including at least one link pivotally connected to the actuator member at one end and the puller slide at the other end to transmit pivotal motion of the actuator member to rectilinear motion of the puller slide.

13. A puller for separating multiple pin electrical conductor connectors as defined in claim 10, wherein said slide and body have at least one cooperating tongue and groove interconnection to assure rectilinear movement between the slide and the body.

14. A puller for separating multiple pin electrical conductor connectors as defined in claim 10, wherein the slide and the body have openings therethrough to permit the conductors to freely pass through the body, the slide and the body having openings therethrough transverse to the direction of the connector pins to permit the conductors to pass freely therethrough.

15. A puller for separating multiple pin electrical conductor connectors of the type having a male connector with a generally rectangular elongated frame and a female connector with a similar generally rectangular elongated frame parallel to and spaced from the male connector frame when the connectors are connected, comprising: a generally "L" shaped body consisting of an elongated base portion and a transverse handle portion, said base portion being bifurcated defining spaced base arms each having a groove in the lower portion thereof fopr receiving and engaging one of the connector frames, a puller slide having spaced puller arms mounted within the base arms for rectilinear movement and each having a groove for receiving and engaging the side of the other connector frame facing the one connector frame, an actuator member pivotally mounted in the body handle with a portion thereof projecting from the handle portion so the user actuates the slide by hand gripping the handle portion with the operator's fingers on the gripping handle extending over and depressing the projecting portion of the actuator member toward the handle portion of the body, including at least one link pivotally connected to the actuator member at one end and the puller slide at the other end to transmit pivotal motion of the actuator member to rectilinear motion of the puller side, said slide and body having at least one cooperating tongue and groove interconnection to assure rectilinear movement between the slide and the body, the slide and the body having openings therethrough to permit the conductors to freely pass through the body.

* * * * *